US005337539A

United States Patent [19]

Barton

[11] Patent Number: 5,337,539

[45] Date of Patent: Aug. 16, 1994

[54] METHOD OF PRODUCING FLEXIBLE SUSPENDIBLE POUCHES AND POUCH PRODUCED THEREFROM

[75] Inventor: Lewis Barton, New York, N.Y.

[73] Assignee: Drake & DiPello, Inc., New York, N.Y.

[21] Appl. No.: 935,155

[22] Filed: Aug. 25, 1992

[51] Int. Cl.[5] ..... B65B 43/04; B65B 61/14

[52] U.S. Cl. ..... 53/413; 53/134.1; 53/455; 53/562

[58] Field of Search ..... 53/413, 455, 562, 134.1, 53/131.2, 411; 383/24, 22

[56] References Cited

U.S. PATENT DOCUMENTS

| | | | |
|---|---|---|---|
| 2,146,308 | 2/1938 | Maxfield . | |
| 2,362,459 | 11/1944 | Barnett . | |
| 2,385,897 | 10/1945 | Waters . | |
| 2,413,686 | 1/1947 | Barnett . | |
| 3,182,430 | 5/1965 | Hoeppner | 53/455 |
| 3,616,991 | 11/1971 | Beck | 229/66 |
| 3,941,306 | 3/1976 | Weikert | 229/53 |
| 4,096,897 | 6/1978 | Cammarata, III | 222/107 X |
| 4,199,062 | 4/1980 | Johnston et al. | 206/525 |
| 4,201,299 | 5/1980 | Bumgarner et al. | 206/554 |
| 4,290,467 | 9/1981 | Schmidt | 53/455 X |
| 4,516,267 | 5/1985 | Kent et al. | 383/22 |
| 4,635,291 | 1/1987 | Barton | 383/24 |
| 4,706,439 | 11/1987 | Barton | 53/413 |
| 5,077,957 | 1/1992 | Brinkmann | 53/455 |

FOREIGN PATENT DOCUMENTS

| | | |
|---|---|---|
| 1222238 | 8/1966 | Fed. Rep. of Germany . |
| 2228681 | 12/1974 | France . |

*Primary Examiner*—James F. Coan

*Attorney, Agent, or Firm*—Scully, Scott, Murphy & Presser

[57] ABSTRACT

A method for the production of flexible pouches each possessing a sealed product-containing pocket and incorporating an integral collar-shaped structure located externally of the pocket to enable suspending of the pouch from a support. More specifically, the method contemplates the sequential in-line production or manufacture of such flexible pouches which are essentially constituted from a sealable, flexible packaging material and which may consist of either a single-layer film material or of a multi-layered laminate so as to enable the containment in the pouches of the most varied types of products possessing widely different properties. In addition to the foregoing, also disclosed is a flexible pouch having a sealed product-containing pocket and incorporating an integral collar-shaped structure which is produced by the inventive method.

36 Claims, 4 Drawing Sheets

METHOD OF PRODUCING FLEXIBLE SUSPENDIBLE POUCHES AND POUCH PRODUCED THEREFROM

BACKGROUND OF THE INVENTION

1. Field of the Invention

The present invention relates to a method for the production of flexible pouches each possessing a sealed product-containing pocket and incorporating an integral collar-shaped structure located externally of the pocket to enable suspending of the pouch from a support. More specifically, the method contemplates the sequential in-line production or manufacture of such flexible pouches which are essentially constituted from a sealable, flexible packaging material and which may consist of either a single-layer film material or of a multi-layered laminate so as to enable the containment in the pouches of the most varied types of products possessing widely different properties. In addition to the foregoing, the invention is also directed to the provision of a novel flexible pouch having a sealed product-containing pocket and incorporating an integral collar-shaped structure which is produced by the inventive method.

In the packaging technology, and especially the aspect thereof which is directed to methods of producing flexible pouches each containing a product in a sealed pocket, and which incorporate physical structure for enabling such pouches to be suspended; for example, for display purposes, such as hangers, apertured pouch extensions, loops or collar-like structures or the like, these kinds of pouches have found widespread acceptance in widely differing commercial and industrial applications. Ordinarily, in many instances, flexible pouches have been produced from thermoplastic sheet or web materials which, upon occasion, depending on the intended use and product stored therein were adapted to be foil-lined or laminated in order to provide sealed liquid-impervious pockets for the containment of fluid or flowable products, such as ketchup, mustard, relish or the like; or a pourable product such as granulated or powdered sugar, salt, pepper or the like. Other types of flexible pouch constructions may be constituted from laminates, generally known in the packaging trade as paper/poly/foil/poly composites; ink-/paper/PE extrusion/foil/HSC (heat seal Coating) polyblend or cellophane/adhesive/polyethylene laminates, among numerous other types of packaging materials which are customized in their properties in correlation with the particular type of use for which they are intended.

However, although the most widely varying types of pouches which are constituted from sealable, flexible packaging materials and which incorporate sealed product-containing pockets and loop, suspension apertures or collar-like suspension structure have been designed and employed in commerce and industry, current methods of production for such pouches have generally been relatively complex and expensive through the need for having to utilize customized and not readily adjustable manufacturing equipment which necessitates physical production steps in the manufacture which do not readily lend themselves to the so-called sequential "in-line" type of manufacture desired for such flexible pouches. The various currently employed manufacturing methods and machines also frequently entail the waste of relatively large quantities of packaging material caused by trimming and discarding portions of such material during production of the pouches which, in view of the extremely high production volumes for such pouches, resultingly leads to uneconomical manufacturing procedures in consideration of the considerable amounts of expensive packaging material being wasted and discarded.

2. Discussion of the Prior Art

Although numerous types of methods and flexible pouches produced by such methods considered herein are known in the packaging technology, these are generally complex in nature and/or uneconomical or, at least deemed expensive from the practical standpoint of having to mass produce such flexible pouches in extremely large quantities, frequently ranging into many millions of pouches for any specific kind.

Thus, in essence, Beck U.S. Pat. No. 3,616,991 discloses a flexible package constituted of two superimposed plastic material sheets, in which a pocket for receiving a product, such a flat article, is formed by four seals encompassing the surface area defined by the article. One of the plastic sheet portions extends beyond the area of the pocket to define a flap portion into which there is punched a cutout to facilitate the package being suspended from a suitable display hook or the like. The flexible packages may be formed in series, with a severing or weakening line being formed to extend through the transverse seal between the article-containing pocket of each sequential package so as to allow for tearing off into individual separated packages. Although this provides for a relatively simple flexible plastic film or sheet package construction incorporating an article or product-receiving pocket and a projecting flap portion enabling suspension of the entire package from an object, the construction thereof requires the trimming of material along the edges of the package, thereby resulting in increased material costs, while necessitating the punching of cutouts into the flap to provide the hanger portion, with the concomitant requirement for separate punching dies. This will also increase the expenditures for different types of manufacturing apparatus and render the manufacturing procedure expensive.

Bumgarner, et al. U.S. Pat. No. 4,201,299 discloses a bag which is constituted of a plastic sheet material, such as polyethylene film, in which there is formed an open pocket for the insertion of a folded newspaper or the like, and in which a collar portion with a cutout is provided at one end for suspension from a doorknob, hook or the like. In this instance, the manufacture of the bag necessitates the folding and subsequent adherence of webs of plastic sheet material and the separate attachment thereto of strips for the collar or neck portion. This renders the entire bag manufacturing process complex and expensive, and does not readily lend itself to the formation of flexible pouches having sealed product-containing pockets and integral collar structure in a continuous "in-line" operation, so as to eliminate any need for special machinery or equipment and with practically no waste material, as is the case with the present invention.

Maxfield U.S. Pat. No. 2,146,308 discloses the continuous or sequential production of product-containing packages, in which a continuous web of a plastic film sheet material is folded into a tubular configuration about a tubular filler while being conducted along a downward path, and wherein a seal is formed along the longitudinal edge by the application of a second web, and a subsequent transverse seal is formed to allow for the formation of a pocket which is open at the upper end thereof, and into which product is then filled by the filler. Hereby, as the continuous web is conveyed downwardly, the formation of subsequent transverse seals produce a series of individual but interconnected sealed product-containing pouches which may thereafter be separated by being severed through the transverse seals so as to form separate pouches. In this instance, in order to allow for the provision of eyelets which will facilitate the pouches to be suspended from a display hook or the like, the longitudinally sealed edge provided by the second folded over web material has the eyelets punched therethrough, and reinforcing members inserted therein for enabling the suspension of each pouch without tearing of the pouch material. This procedure necessitates implementing an extremely complex manufacturing operation requiring the use of punching dies, and the insertion of rings or grommets into the eyelets. Consequently, both as to method and structure, Maxfield is not readily adapted to provide economically mass-produced product-containing flexible pouches of the type contemplated by the present invention.

Jones, et al. U.S. Pat. No. 4,208,819 discloses a recipe booklet which incorporates a flap member of plastic material having an aperture punched therein to form a collar structure for suspending the booklet from a container, such as from the neck of a bottle. In this instance, the overall structure is formed from individual components which must be folded, the flap member adhered thereto and the suspending aperture or opening punched therethrough in order to provide the bottle neck-engaging collar structure. Consequently, this necessitates equipment such as punching dies and adhesive applicators, thereby rendering the method of manufacture cumbersome and expensive.

Johnston, et al. U.S. Pat. No. 4,199,062 discloses a bag or container of a flexible material for dispensing a liquid, having extensions which are formed at opposite ends of the container to allow for the insertion of dispensing tubes at one end and for the formation of an aperture at the opposite end for suspending the bag in a vertical orientation from a hook or suitable support. In this case, the formation of the suspending bag portion and the other extensions requires the use of complex punching and forming equipment which does not readily lend itself to the simple "in-line" formation of the product-containing flexible pouches by a manufacturing method as contemplated by the present invention.

Similarly, Cammarata, III, U.S. Pat. No. 4,096,897 discloses a liquid-containing pouch of a flexible and collapsible material in which an extension at one end of the pouch includes an opening for suspending the pouch from a hook or suitable support. As in Johnston, et al., the construction of a flexible pouch of that type is of a relatively complex nature requiring the use of different types of apparatus, such as cutting, sealing and punching equipment, thereby rendering the manufacturing costs and material consumption extremely uneconomical, particularly when applied to the mass production of a simple type of flexible pouch which is provided for disposable or single-use purposes as contemplated by the present invention.

Weikert U.S. Pat. No. 3,941,306 discloses the formation of sealed packages from a continuous extruded tube of a flexible film material, in which transverse seals are formed to provide pockets open at an upper end, with a filling tube being inserted into the tube above the upper ends of each transverse seal, and subsequent to product being filled into each pocket, a longitudinal seal is then formed to seal each pocket across the transverse seals and excess material externally of the pocket is removed through the use of a rotary cutting tool which slits through both or opposite wall surfaces of the material. Moreover, the pouches are adapted to be severed within their transverse seals so as to provide individual and mutually separated pouches. This particular type of construction, although producing sealed pouches containing a product, does not enable the formation of collar-forming structure, and also requires a closed tube to be employed for forming the pouches while, subsequent to the finishing of each pouch, a considerable amount of excess material must be cut off and discarded, thereby leading to considerable material waste and increased costs while concurrently inhibiting the manufacture of such pouches from either a folded single web or laminated web construction. In essence, Weikert is only adapted to be employed with material formed by tubular extrusion, and does not lend itself to be utilized with various types of laminates as mentioned hereinabove.

Similarly, Barnett U.S. Pat. Nos. 2,413,686 and 2,362,459 each disclose the formation of pouches containing sealed pockets which, however, again do not provide for the formation of novel collar-forming structure analogous to that disclosed and contemplated by the present inventive method.

Other patents which relate to the formation of pouches or packages containing suspending collars, include Kent, et al. U.S. Pat. No. 4,516,267 which pertains to the application of a non-shrinkable tape to the exterior of a pouch of a heat shrinkable material; whereas German Patent 1 222 238 discloses the slitting of material from a web having pouches formed therein and then reattaching the separated material by means of a transverse heat seal to form carrying handles. This particular concept is also described in French Patent 2,228,681 which slits plastic packages to form integral handles reattached thereto by means of heat seals. Another patent of interest and of this type includes Waters U.S. Pat. No. 2,385,897 which includes a vertical filling device for forming continuous sequences of packages through a vertical feed sequence.

Finally, Barton U.S. Pat. Nos. 4,635,291 and 4,706,439 disclose the formation of sealed pouches in which a plurality or at least two parallel longitudinal slits are adapted to form an integral collar construction with a heat-sealed pouch containing a product. However, these particular methods and pouches as disclosed in the Barton patents require extremely complex slitting and sealing procedures and equipment, inasmuch as the multiple slits form a multiplicity of discrete material portions which must then be reattached through transverse heat seals in order to provide a collar structure which is offset from one end or edge of each pouch externally of a product-containing pocket.

SUMMARY OF THE INVENTION

Accordingly, it is an object of the present invention to provide a method of producing product-containing pouches incorporating collar-shaped structures, preferably of an initially integral nature therewith, which is simple in nature and implementation in comparison with the current state-of-the-art of the packaging industry in producing a flexible pouch construction for the containment and suspension and/or display of widely divergent kinds of products, and which readily lends itself to the most widely employed diversities in sealable flexible packaging materials of consisting of either single layer webs or of laminated material constructions.

In order to ameliorate or possibly eliminate the drawbacks and limitations currently encountered in the packaging technology with respect to the sequential mass production of flexible pouches each being formed with product-containing pockets and suspension or hanging structures in the form of collar-like portions through inexpensive and economically viable in-line production methods, the present invention contemplates the provision of a method for producing flexible pouches of that type in a sequential operation from sealable flexible packaging materials of the most widely divergent and differing kinds so as to be able to accommodate products of various types while still being able to maintain the basically inexpensive nature of producing the flexible product-containing pouches.

In order to achieve the foregoing, the method contemplates the advance of a continuous web of a sealable flexible packaging material; for instance, such as either a plastic film web or a laminate of widely varying types of materials, which are supplied from a continuous web of either folded or multiple sheets of material. Hereby, in order to produce the individual pouches, transverse seals relative to the machine direction of the web are formed in the facing sidewalls of the generally cross-sectionally flattened V-shaped material web so as to produce normally rectangular pockets which are initially closed or sealed along three sides thereof, and whereby prior to the forming of such transverse seals, one of the sidewalls has a longitudinal and continuous slit formed therein and which is inwardly offset from the free edge of the V-shape thereof such that, subsequent to the filling of each pocket with a specific product, a continuous longitudinal seal is imparted to the layers of the web, thereby sealing such pocket immediately adjacent or in close proximity with the longitudinal s/it previously formed in one of the sidewalls, so as to thereby reattach the severed material to the opposing sidewall at the intersections between the transverse and longitudinal seals and concurrently form a completely sealed product-containing pocket and loop-like collar-shaped structure externally thereof for suspending the pouch from a suitable support.

In connection with the foregoing method, pursuant to a specific feature of the invention, weakening lines may be formed coextensively and in parallel relationship with the transverse seals; with such weakening lines being either discontinuous slits or lines of perforations which enable the pouches at some suitable time, to be manually separated from each other while initially permitting a number or series of the pouches to remain attached to each other; for example, if it is desired to package such pouches in specified multiples in a container adapted for either the wholesale or retail trade.

Alternatively, it is also possible to contemplate that, subsequent to the sealing of the pouches to form the sealed product-containing pockets and collar-shaped structures, rather than incorporating such weakening lines as mentioned hereinbefore, to actually completely sever the pouches from each other coextensively with the transverse seals, but while maintaining the integrity of the latter, to resultingly provide pouches which are completely separated from each other.

Moreover, in addition to the method described hereinbefore, which is normally implemented through the intermediary of a form-fill sealing machine, as is well-known in the packaging industry, a further method pursuant to the invention utilizes an arrangement incorporating a horizontal overwrap machine. In this instance, a continuous web of flexible sealable packaging material is advanced and upon being dispensed from a suitable supply roll, folded about a product so as to form a closed essentially tubular structure in which the longitudinal side edges of the web are superimposed to form upstanding flange-like sidewalls. These superimposed sidewalls are joined through the application of a continuous longitudinal seal while one of the sidewalls, preferably that of greater upstanding length, has a continuous slit formed therein so as to sever an edge portion from the remaining sidewall structure. This particular upstanding sidewall structure is then folded downwardly into surface contact with the remaining product-containing tubular package portion, and sequentially spaced transverse seals imparted to the tubular structure, and concurrently to the folded-down sidewalls, so as to close the ends of the pouch thereby forming a sealed pocket containing the product while concurrently reattaching the ends of the severed sidewall portion so as to form a collar structure externally of the pouch.

Accordingly, it is an object of the present invention to provide a novel and unique method for forming product-containing pouches which are constituted from a sealable flexible packaging material and which incorporate collar-shaped structures for suspending or hanging the pouches from suitable objects or supports.

Another object of the present invention is to provide a method for the in-line serial production of flexible pouches of the type described herein which may be produced from webs of either a single-ply film material or from laminates of differing materials, wherein the web is constituted from either a folded material or superimposed webs which are fastened or edge-sealed to each other.

Moreover, the invention also has as an object to contemplate the provision of flexible pouches of sealable flexible packaging materials incorporating collar-shaped structure therewith and which are produced by the methods pursuant to the present invention.

BRIEF DESCRIPTION OF THE DRAWINGS

Reference may be now be had to the following detailed description of preferred embodiments of arrangements for implementing methods of producing flexible pouches and resultant pouch and collar construction pursuant to the invention, taken in conjunction with the accompanying drawings; in which.

DETAILED DESCRIPTION

Figure 1:
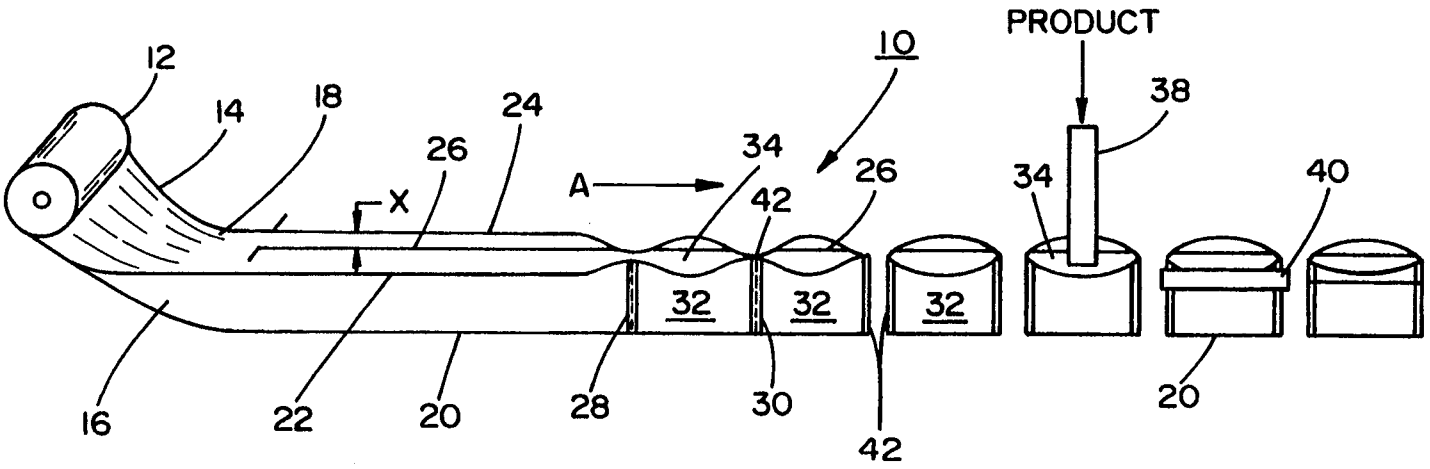
FIG. 1 is a generally diagrammatic side elevational view of an arrangement for implementing the method of producing flexible pouches pursuant to the invention.

Reverting in greater particularity to the drawings, and especially FIG. 1, the latter illustrates an arrangement for implementing the inventive method of serially mass-producing flexible pouches; in which the pouch-producing arrangement 10 incorporates a supply source in the form of a mill roll 12 for the dispensing therefrom of a web of a sealable flexible packaging material 14 which is advanced along the machine direction in the direction of arrow A.

In this particular exemplary case, by way of illustration, the web 14 of packaging material is constituted from a single ply of a thermoplastic film material which is folded into an essentially flattened V-shaped configuration to provide first and second side walls 16 and 18 of generally equal widths so as to provide a closed bottom edge 20 and upwardly opening respective sidewall edges 22 and 24. For example, the thermoplastic film material may be polyethylene, possibly axially or biaxially oriented for purposes of enhanced film strength, although numerous other plastic film materials readily lend themselves for this purpose; the production of flexible pouches, as is well known in the packaging technology.

As the folded web 14 is advanced in the machine direction, as shown by arrow A, in this instance in a generally horizontal direction while in an upright orientation, a single continuous slit 26 is formed in one of the sidewalls, in this case in sidewall 18, at a predetermined spacing X inwardly from the edge 24 towards the closed bottom edge 20. This slit 26 may be formed through the intermediary of a single razor or cutting knife or rotary blade, as is well known in the technology.

As the plastic film web 14 is advanced in the machine direction, the arrangement has sealers forming vertical seals 28 and 30 which are at a predetermined axial distance from each other, and which extend transversely across the entire width of the folded web 14, seal the sidewalls to each other so as to, in conjunction with closed bottom edge 20, form product-receiving pockets 32 which are upwardly open at their upper ends 34.

Thereafter, each pocket 32, while the web 14 is advancing motion, or forwardly indexed in an intermittent advancing is filled with a suitable product while the opening 34 is maintained in an opened position through the application of vacuum devices, such as through suction cups or the like applied to the outer sides of each of the sidewalls or at least one of the sidewalls of the web 14 intermediate the transverse seals 28, 30. The product being filled in through the filler 38, may be a pourable, flowable or even liquid product, or any kind of item which is readily adapted to being housed in the pocket 32 of each pouch.

Figure 4:
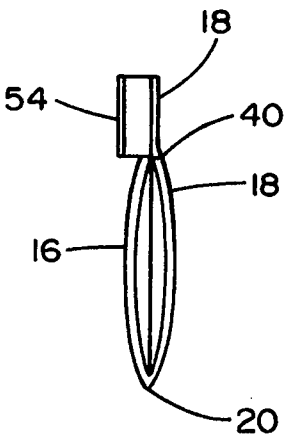
FIG. 4 illustrates a sectional view taken along line 4—4 in FIG. 2.
Figure 3:
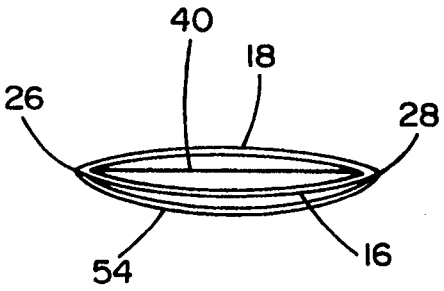
FIG. 3 illustrates a sectional view taken along line 3—3 in FIG. 2.
Figure 2:
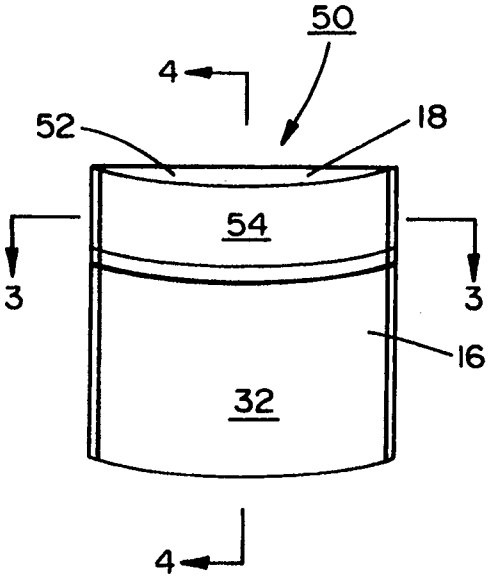
FIG. 2 illustrates a perspective view of a typical flexible pouch with collar structure produced in accordance with the method of the invention.

Thereafter, during the continued advance of the web 14 along the machine direction A, a horizontal seal 40 is applied to join sidewalls 16, 18 immediately below slit 26 formed in each pouch so as to extend between transverse seals 28, 30 and to thereby seal each pocket 32 encapsulating the product contained therein, while concurrently producing a collar-shaped structure from the previously severed portion of the slit-apart sidewalls externally of each sealed pocket 32. The loop-like, collar-shaped structure is more closely elucidated hereinbelow in conjunction with FIGS. 2 to 4 of the drawings.

Concurrently with or subsequent to the formation of the transverse or vertical seals 28, 30 joining the sidewalls 16, 18, suitable weakening lines 42 may be formed in these seals coextensively with each of the transverse seals so as to enable the separation subsequent time of the various individual pouches from each other. Alternatively, instead of providing such weakening lines 42, which may be in the form of either discontinuous slits or perforations extending through the thickness of the seals, the pouches may be completely severed from each other by a through-cut implemented by a vertical cutter fully extending through the transverse seals to provide a finished product-filled pouch as shown more specifically in FIGS. 2 through 4 of the drawings.

As is illustrated, the pouch 50 includes an open upper end 52 between the sidewalls 16, 18, whereby the collar portion 54 extends between the upper edge 22 of the sidewall 16 of the pouch and the horizontal or longitudinal pocket-closing seal 40 which is formed by a longitudinal sealer so as to extend the full length between the transverse 26 seals and 28 forming opposite side edges of the pouch, as shown in FIG. 1. Consequently, the sealed product-containing pocket 32 in each pouch 50 is dimensioned to have the upper sealed edge thereof produced by seal 40 closely adjacent to the slit 26, forming a loop-like collar structure of the previously severed portion 54 of sidewall 16, to enable pulling this loop-like collar portion away from the facing surface of sidewall 18 of the pouch 50, creating an opening or collar for suspending the product-filled pouch 50 from a suitable support or object, such as a hanger, hook, bottleneck or the like.

In lieu of the single V-shape folded web of a sealable flexible packaging material, such as polyethylene film or the like, which is folded as it is unrolled from the mill roll 12, the pouch 50 may also be formed from two superimposed sheets of material in which the closed edge at the web bottom 20 may be formed by sealing the sheets together through the imposition of a continuous longitudinal bottom edge seal, thereby providing the essentially flattened V-shaped cross-sectional web structure as discussed with regard to the foregoing method of production utilizing a folded film web. In this instance, when employing a thermoplastic film material, all of the seals may be produced through the formation of suitable heat seals, as is well-known in the plastics technology.

Figure 7:
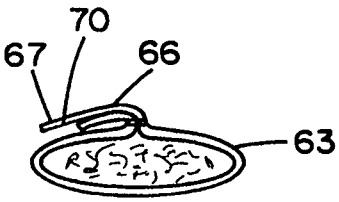
FIG. 7 illustrates a sectional view taken along line 7—7 in FIG. 5.
Figure 5:
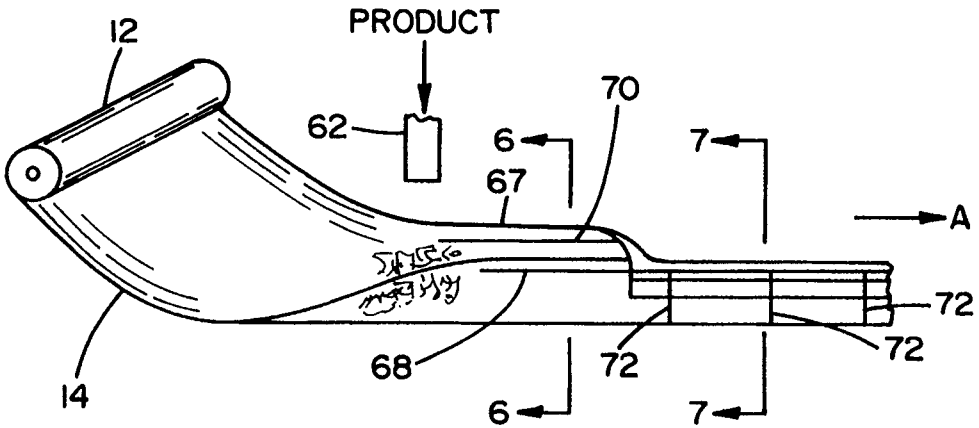
FIG. 5 illustrates, generally diagrammatically, a modified arrangement for producing flexible pouches.
Figure 6:
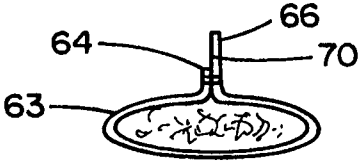
FIG. 6 illustrates a sectional view taken along line 6—6 in FIG. 5.

Referring to the embodiment of FIGS. 5 through 7 of the drawings, in which similar or identical elements referred to in connection with FIG. 1 are identified by the same reference numerals, in this instance the web 14 which is advanced in the machine direction from the mill roll 12 is essentially folded in a trough-like manner about a product being introduced from an infeed conduit 62, with the web 14 then being folded about the product, as shown in FIG. 6 of the drawings so as to provide a tubular structure 63 in transverse cross-section. The side edges of the web 14 extend away from the tubular structure to provide sidewalls 64 and 66, wherein sidewall 66 is of a greater width, and are joined to each other by means of a continuous longitudinal seal 68 while a continuous slit 70 is formed in sidewall 66 in parallel relationship with the edge of the upstanding sidewall 66 to form a severed strip 67.

Figure 8:
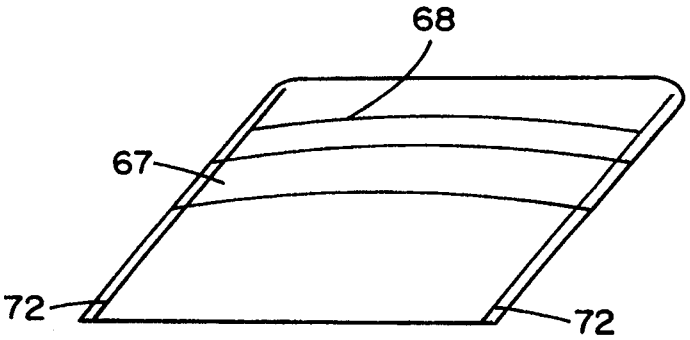
FIG. 8 illustrates a perspective view of a flexible pouch with collar structure produced with the arrangement of FIG. 5.

Thereafter, by means of a suitable folding mechanism (not shown) the sealed together sidewalls 64 and 66 and strip 67 are folded downwardly, as shown in FIG. 7, into surface contact with the tubular product-enclosing portion 63 of the web 14. Thereafter, sequentially spaced transverse seals 72 are formed to extend across the entire width of the tubular portion 63 transversely of the machine or advancing direction thereof, and over the folded down sidewalls 64, 66 so as to join the ends of the sidewalls to the tubular portion, while thereby reattaching the severed strip portion 67 of the sidewall 66 to the surface at the opposite ends of the pouch, and with the seals 72 concurrently forming closed pockets containing the product. Consequently, this will produce a pouch with an integral fastened collar structure 74, as shown in FIG. 8 of the drawings, in which a single pouch is represented as separated from the continuous web by means of weakening lines which are formed in the transverse seals 72 in a manner analogous to that described with reference to FIG. 1 of the drawings.

Alternatively, the materials employed in the production of the pouches may be constituted from various types of laminates including paper and foil having a sealable material interposed therebetween so as to form sealed packages or pouches through the application of so-called cold or pressure seals; in effect, through an adhesive sealing rather than heat sealing as normally employed for thermoplastic films. Normally, when employing laminated materials, two superimposed sheets are utilized rather than a single folded web, although this is not an absolute limitation. Among various types of laminates which are adapted to provide suitable flexible pouches, may be those commonly referred to in the packaging trade as paper/poly/foil/poly laminates, and those including cellophane/adhesive/polyethylene laminates; or ink/paper/polyethylene extrusion film/foil/-heat seal coating poly blends (HSC), whereby the exterior of the various packaging surfaces may be imparted suitable imprinted or embossed indicia, advertising and/or product identifying legends.

In addition to the foregoing, instead of heat seals or cold adhesive seals, there can also be considered the use of crimping seals clampingly engaging the opposite sidewall surfaces with each other, especially when the product is not a liquid, pourable or flowable product, but rather is a large-sized item; for instance, such as one or more screws, metal washers, gaskets, hooks or the like, for which no liquid-impervious or gas-tight sealing is required for the pouch pocket.

Furthermore, although the invention as described herein is illustrated from the viewpoint of representing horizontal pouch-forming and filling arrangements, it is readily apparent to one of skill in the art that the foregoing invention would also be applicable to vertical packaging arrangements or the like, necessitating only relatively inexpensive modifications.

Figure 9:
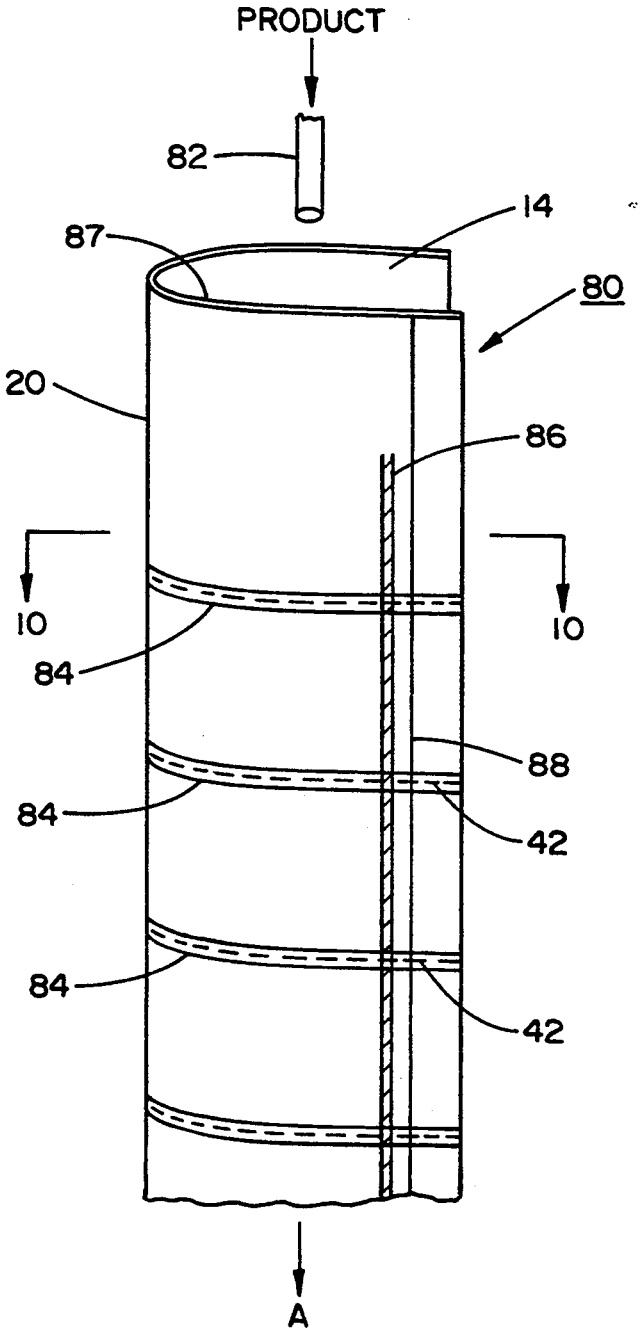
FIG. 9 illustrates an arrangement similar to FIG. 1, but for a vertically operating arrangement.
Figure 10:
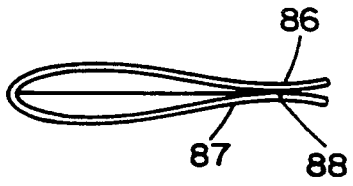
FIG. 10 illustrates a sectional view taken along line 10—10 in FIG. 9.

Having particular reference to FIG. 9 and 10 of the drawings, this arrangement 80 is similar in operation with the arrangement as shown in FIG. 1 of the drawings; however, in this instance, the unit is a vertical filling machine, in which the product is introduced through a vertical filler tube 82 into an upwardly opening pouch formed by a first transverse seal 84 and a longitudinal seal 86, with the opposite edge 20 of the folded web 14 being closed. Concurrently, with the formation of the longitudinal seal 86, one of the sidewalls 87 of the web 14 has a single slit 88 formed therein proximate and externally of the longitudinal seal 86, and with the formation of the transverse seals 84 which are arranged in predetermined space sequence, the ends of the severed material of the sidewall will be reattached to the opposite sidewall, so as to form an essentially loop-shaped collar structure, as in FIG. 1, externally of the closed pocket enclosing the product. Thereafter, the individual pouches, as in the instance of the embodiment of FIG. 2, may be separated from each other by means of the weakening lines 42 which are formed in each of the transverse seals 84.

Although the foregoing pouches have been described as possessing collar-shaped structure enabling the suspension of the pouches, these collar structures, and particularly that shown in the package of FIG. 8, may be employed for forming suitable retainers for separate coupons or the like which may be slid underneath the collar into contact with the surface of the pouch and engaged therein, such coupons being either premiums or discount coupons, as is well known in the retail trade.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A method of producing a series of flexible pouches each having a sealed product-containing pocket for the containment of a product and including an integral collar-shaped portion located externally of said pocket to enable suspending said pouch from a support cooperating with said collar-shaped portion; said method comprising the steps of:

(a) advancing a web of a flexible sealable packaging material having a generally V-shaped cross-sectional configuration consisting of first and second sidewalls forming a closed edge and opposite free edges;

(b) forming a continuous slit in one said sidewall for the formation of said integral collar-shaped portion constituted from the material of said one said sidewall extending in parallel with and offset from the free edge of said sidewall towards the closed edge of said web so as to sever a portion of said sidewall;

(c) forming continuous seals extending transversely of the direction of advance of said web at the closed edge and free edges thereof, said seals extending across the width of said sidewalls from said closed edge to said free edges to an extent so as to cause the portion of said one sidewall severed by said continuous slit to be reattached to the other said sidewall at the junctures of said severed portion with said transverse seals and to form said collar-shaped portion, said transversely extending seals and said closed edge between said sidewalls conjointly forming pockets of specified dimension in said web, each said pocket having an opening facing the free edges of said sidewalls intermediate adjacent of said transversely extending seals;

(d) introducing a product into each said pocket through said opening;

(e) and forming a longitudinal seal joining said sidewalls proximate said slit for sealing said opening so as to seal said pocket about the product and concurrently forming said collar-shaped portion from said sidewall having said slit formed therein.

2. A method of producing a series of flexible pouches each having a sealed product-containing pocket for the containment of a product and including an integral collar-shaped portion located externally of said pocket to enable suspending said pouch from a support cooperating with said collar-shaped portion; said method comprising the steps of:

(a) advancing a web of a flexible sealable packaging material;

(b) sequentially depositing product onto said web while advancing said web;

(c) folding said web about said product so as to form a generally tubular structure with upstanding flange-like sidewalls extending from said tubular structure in superimposed relationship along the direction of advance of said web, one of said sidewalls being wider than the other side sidewall so as to project therebeyond;

(d) and forming a continuous longitudinal seal joining said sidewalls proximate the tubular web structure;

(e) forming a continuous slit in said wider sidewall for the formation of said integral collar-shaped portion constituted from the material of said one said sidewall extending in parallel with and offset from the free edge thereof towards said longitudinal seal joining said sidewalls, so as to sever a portion of said sidewall;

(f) flattening said jointed sidewalls and said severed sidewall portion against the surface of said tubular web structure;

(g) and forming continuous seals extending transversely of the direction of advance of said web at spaced intervals so as to sealingly join transverse ends of said tubular web structure, the superimposed ends of said sidewalls and simultaneous reattaching said severed sidewall portion of the juncture thereof with said seal to concurrently form a sealed pocket enclosing the product between adjacent of said transverse seals and product a loop-shaped collar from the material of said reattached sidewall portion.

3. A method of producing a series of flexible pouches each having a sealed product-containing pocket for the containment of a product and including an integral collar-shaped portion located externally of said pocket to enable suspending said pouch from a support cooperating with said collar-shaped portion; said method comprising the steps of:

(a) downwardly advancing a web of a flexible sealable packaging material having a generally V-shaped cross-sectional configuration consisting of first and second sidewalls of specified widths having a closed side edge and opposite facing free edges;

(b) forming a single continuous slit in one said sidewall for the formation of said integral collar-shaped portion constituted from the material of said one said sidewall extending in parallel with and offset from the free edge of said sidewall towards the closed edge of said web so as to sever a portion of said sidewall;

(c) forming continuous longitudinal seal joining said sidewalls proximate said slit intermediate said slit and closed side edge;

(d) sequentially forming continuous seals extending transversely of the direction of advance of said web at spaced intervals for joining said sidewalls intermediate the closed side edge and free edges thereof, said seals extending the width of said sidewalls between said edges to an extent to cause the portion of said one sidewall severed by said continuous slit to be reattached to the other said sidewall at the junctures of said severed portion with said transverse seals and to form said collar-shaped portion from the reattached material of said severed sidewalls, said transversely extending seals and said closed bottom edge conjointly forming pockets of specified dimension in said web, each said pocket having an upwardly facing opening upstream of the initially formed of said transversely extending walls;

(e) introducing a product into said pocket through said opening;

(f) and sealing said opening through the forming of a sequentially following transverse seal so as to enclose the product in said pocket.

4. A method as claimed in claim 1 or 2 or 3, wherein said flexible packaging material comprises a thermoplastic film; and said transverse and longitudinal seals comprise heat seals.

5. A method as claimed in claim 1 or 2 or 3, wherein weakening lines are formed in and are coextensive with said transverse seals to facilitate separation of said pouches from each other while maintaining the integrity of said sealed pockets.

6. A method as claimed in claim 5, wherein said pouches are severable from each other along said transversely extending seals subsequent to the sealing of each pocket to provide individual pouches while maintaining the integrity of the sealed pocket of each said pouch.

7. A method as claimed in claim 5, wherein said weakening lines comprise a line of perforations extending through said transverse seals.

8. A method as claimed in claim 5, wherein said weakening lines comprise discontinuous slits extending through said transverse seals.

9. A method as claimed in claim 4, wherein said advancing web comprises first and second superimposed sheets of said thermoplastic film material constituting said first and second sidewalls, including sealing said superimposed sheets along one of the contiguous edges thereof to form said closed edge joining said sheets of film material.

10. A method as claimed in claim 9, wherein said longitudinal edge seal is a heat seal.

11. A method as claimed in claim 1 or 2 or 3, wherein said collar-shaped portion is of a width extending between said slit in said one sidewall and the free edge of said one sidewall.

12. A method as claimed in claim 1 or 2 or 3, wherein the material of said web comprises a laminate.

13. A method as claimed in claim 12, wherein said laminate comprises a plastic film having a metallic foil liner adhesively fastened thereto.

14. A method as claimed in claim 12, wherein said laminate includes a printing layer.

15. A method as claimed in claim 14, wherein said printing layer comprises a paper-based material.

16. A method as claimed in claim 12, wherein said laminate is selected from the group of materials consisting of paper/poly/foil/poly laminates; cellophane/adhesive/polyethylene laminates; and ink/paper/-polyethylene extrusion film/foil/heat seal coating poly blends (HSC).

17. A method as claimed in claim 1 or 2 or 3, wherein decorative indicia and/or legends are imprinted or embossed on at least one external surface of said pouch.

18. A flexible pouch having a sealed product-containing pocket for the containment of a product and including an integral collar-shaped portion located externally of said pocket to enable suspending said pouch from a support cooperating with said collar-shaped portion; said pouch being formed from:

(a) a web of flexible sealable packaging material having an essentially V-shaped cross-sectional configuration consisting of first and second sidewalls of specified widths having a closed edge and opposite facing free edges;

(b) a continuous slit in one said sidewall extending in parallel with and offset from the free edge of said one sidewall towards the closed edge for severing a portion of said sidewall and for forming said collar-shaped portion from the material of said one sidewall;

(c) continuous seals extending transversely of said web at spaced intervals for joining said sidewalls intermediate the bottom and free edges thereof, said seals extending across said sidewalls between said edges to an extent to attached the ends of the severed portion of said one sidewall to the other said sidewall at the junctures of said severed portion with said transverse seals to form said collar-shaped portion from said one sidewall, said transversely extending seals and said closed bottom edge conjointly forming a pocket of specified dimension intermediate said transvesely extending seals to enable filling said pocket with a specified quantitiy of a product;

(d) and a longitudinal seal joining said sidewalls to seal said opening proximate said slit at the side thereof towards the pocket so as to enclose the product in said pocket.

19. A flexible pouch as claimed in claim 18, wherein said flexible packaging material is a thermoplastic film, and said transverse and longitudinal seals comprise heat seals.

20. A flexible pouch as claimed in claim 18, wherein weakening lines are formed in and are coextensive with said transverse seals to facilitate separation of a plurality of serially formed and interconnected of said pouches from each other while maintaining the integrity of the sealed pocket of each pouch.

21. A flexible pouch as claimed in claim 20, wherein said pouches are severable from each other along said transversely extending seals while maintaining the integrity of the sealed pocket of each pouch.

22. A flexible pouch as claimed in claim 20, wherein said weakening lines comprise a line of perforations extending through each of said transverse seals.

23. A flexible pouch as claimed in claim 20, wherein said weakening lines comprise discontinuous slits extending through each of said transverse seals.

24. A flexible pouch as claimed in claim 18, wherein said web comprises first and second superimposed sheets of said packaging material respectively constituting said first and second sidewalls, and a continuous longitudinal seal joining said superimposed sheets along one of the contiguous edges thereof and forming said closed edge.

25. A flexible pouch as claimed in claim 24, wherein said longitudinal edge seal is a heat seal.

26. A flexible pouch as claimed in claim 18, wherein said collar-shaped portion is of a width extending between said slit in said one sidewall and the free edge of said sidewall.

27. A flexible pouch as claimed in claim 18, wherein the material of said pouch comprises a laminate.

28. A flexible pouch as claimed in claim 27, wherein said laminate material comprises a plastic film having a metallic foil liner adhesively fastened thereto.

29. A flexible pouch as claimed in claim 27, wherein said laminate material includes a printing layer.

30. A flexible pouch as claimed in claim 29, wherein said printing layer comprises a paper-based material.

31. A flexible pouch as claimed in claim 27, wherein said laminate is selected from the group of materials consisting of paper/poly/foil/poly laminates; cellophane/adhesive/polyethylene laminates; and ink-/paper/polyethylene extrusion film/foil/heat seal coating poly blends (HSC).

32. A flexible pouch as claimed in claim 18, wherein decorative indicia and/or legends are imprinted or embossed on at least one external surface of said pouch.

33. A flexible pouch as claimed in claim 27, wherein said laminate material is a liquid-impervious and gas-impermeable composite.

34. A flexible pouch as claimed in claim 18, wherein said web in (a) is wrapped about a product in a substantial U-shape having flange portions forming said first and second sidewalls for producing said collar-shaped portion.

35. A flexible pouch as claimed in claim 34, wherein the collar-shaped portion of said pouch is folded against the surface of the pocket-containing portion of said pouch.

36. A flexible pouch as claimed in claim 35, wherein the ends of said folded down collar-shaped portion are sealed to said surface through said transverse seals.

* * * * *

UNITED STATES PATENT AND TRADEMARK OFFICE

CERTIFICATE OF CORRECTION

PATENT NO. : 5,337,539

DATED : August 16, 1994

INVENTOR(S) : Lewis Barton

It is certified that error appears in the above-indentified patent and that said Letters Patent is hereby corrected as shown below:

Column 5, line 42: "s/it" should read --slit--

Column 11, line 23, Claim 2: "side" should read --said--

Column 11, line 25, Claim 2: delete --and--

Column 11, line 34, Claim 2: "jointed" should read --joined--

Column 11, line 43, Claim 2: "seal" should read --seals--

Column 11, line 45, Claim 2: "product" should read --produce--

Column 11, line 67, Claim 3: after "closed" insert --side--

Column 12, line 1, Claim 3: after "forming" insert --a--

UNITED STATES PATENT AND TRADEMARK OFFICE

CERTIFICATE OF CORRECTION

PATENT NO. : 5,337,539
DATED : August 16, 1994
INVENTOR(S) : Lewis Barton

It is certified that error appears in the above-indentified patent and that said Letters Patent is hereby corrected as shown below:

Column 12, line 20, Claim 3: "walls" should read --seals--.

Signed and Sealed this

Thirteenth Day of December, 1994

*Attest:*

*Attesting Officer*

BRUCE LEHMAN

*Commissioner of Patents and Trademarks*